US009109821B2

(12) United States Patent
Kim et al.

(10) Patent No.: US 9,109,821 B2
(45) Date of Patent: Aug. 18, 2015

(54) CONDENSER FOR VEHICLE

(75) Inventors: Jae Yeon Kim, Hwaseong-si (KR); Wan Je Cho, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 517 days.

(21) Appl. No.: 13/531,243

(22) Filed: Jun. 22, 2012

(65) Prior Publication Data

US 2013/0126126 A1 May 23, 2013

(30) Foreign Application Priority Data

Nov. 21, 2011 (KR) ..... 10-2011-0121886

(51) Int. Cl.

| | |
|---|---|
| ***F28F 9/24*** | (2006.01) |
| ***F25B 39/04*** | (2006.01) |
| ***F28F 9/02*** | (2006.01) |
| ***F28D 1/053*** | (2006.01) |
| *F28D 21/00* | (2006.01) |

(52) U.S. Cl.

CPC ..... *F25B 39/04* (2013.01); *F28D 1/05375* (2013.01); *F28F 9/0204* (2013.01); *F28F 9/0253* (2013.01); *F28F 9/0273* (2013.01); *F25B 2339/044* (2013.01); *F25B 2400/02* (2013.01); *F28D 2021/0084* (2013.01)

(58) Field of Classification Search

CPC ..... F25B 39/04; F25B 2339/044; F25B 2339/0441; F28F 9/026; F28F 9/0263

USPC ..... 165/110, 32; 62/509

See application file for complete search history.

(56) References Cited

U.S. PATENT DOCUMENTS

| | | | | |
|---|---|---|---|---|
| 4,141,409 | A * | 2/1979 | Woodhull et al. | 165/110 |
| 5,228,315 | A * | 7/1993 | Nagasaka et al. | 62/509 |
| 5,884,503 | A * | 3/1999 | Inaba | 62/509 |
| 5,896,754 | A * | 4/1999 | Balthazard et al. | 165/132 |
| 6,062,303 | A * | 5/2000 | Ahn et al. | 165/110 |
| 6,125,927 | A * | 10/2000 | Hubert | 165/174 |
| 6,796,374 | B2 * | 9/2004 | Rong | 165/174 |
| 7,806,171 | B2 * | 10/2010 | Taras et al. | 165/174 |
| 2008/0023185 | A1 * | 1/2008 | Beamer et al. | 165/174 |
| 2009/0173102 | A1 * | 7/2009 | Ogasawara | 62/498 |
| 2010/0089559 | A1 * | 4/2010 | Gorbounov et al. | 165/174 |

FOREIGN PATENT DOCUMENTS

| | | | | |
|---|---|---|---|---|
| GB | 2250336 | A * | 6/1992 | 165/174 |
| JP | 04295599 | A * | 10/1992 | 165/174 |
| JP | 3937973 | B | 4/2007 | |
| JP | 2008-024200 | A | 2/2008 | |
| JP | 4100184 | B | 3/2008 | |
| KR | 10-2009-0045473 | A | 5/2009 | |

* cited by examiner

*Primary Examiner* — Leonard R Leo

(74) *Attorney, Agent, or Firm* — Morgan, Lewis & Bockius LLP

(57) ABSTRACT

A condenser for a vehicle may include first and second headers, a heat-exchanging portion disposed between the first and second headers, a coolant tank mounted at an outer side of the first header and having a coolant inlet and a coolant outlet, the coolant tank to supply the coolant to the heat-exchanging portion and to receive through the first header the coolant passing through the heat-exchanging portion and the second header, and a receiver-drier portion connected to the second header to perform gas-liquid separation and moisture removal from the coolant having passed through the heat-exchanging portion, wherein an inner space of the coolant tank is divided into an upper portion and a lower portion by a first partition disposed between the coolant inlet and the coolant outlet, and a spiral groove for causing the coolant to rotate is formed at the upper portion connected to the coolant inlet.

20 Claims, 8 Drawing Sheets

CONDENSER FOR VEHICLE

CROSS-REFERENCE TO RELATED APPLICATION

The present application claims priority to Korean Patent Application No. 10-2011-0121886 filed in the Korean Intellectual Property Office on Nov. 21, 2011, the entire contents of which is incorporated herein for all purposes by this reference.

BACKGROUND OF THE INVENTION

1. Field of the Invention

The present invention relates to a condenser for a vehicle. More particularly, the present invention relates to a condenser for a vehicle that condenses coolant through heat-exchange with air if gaseous coolant and liquefied coolant are mixed and flowed into the condenser.

2. Description of Related Art

Generally, an air conditioning for a vehicle maintains suitable cabin temperature regardless of ambient temperature and realizes comfortable indoor environment.

Such an air conditioning includes a compressor compressing a refrigerant, a condenser condensing and liquefying the refrigerant compressed by the compressor, an expansion valve quickly expanding the refrigerant condensed and liquefied by the condenser, and an evaporator evaporating the refrigerant expanded by the expansion valve and cooling air which is supplied to the cabin in which the air conditioning is installed by using evaporation latent heat.

Herein, the condenser cools compressed gas refrigerant of high temperature/pressure by using an outside air flowing into the vehicle when running and condenses it into liquid refrigerant of low temperature.

Such a condenser is generally connected through a pipe to a receiver-drier which is provided for improving condensing efficiency through gas-liquid separation and removing moisture in the refrigerant.

According to a conventional condenser, however, radiation fins and tubes connected to headers disposed at both sides of the condenser should be connected in vertical manner when being connected with coolant pipes for receiving and discharging the coolant. Therefore, it is difficult to construct a layout in a small engine compartment.

Since spaces between the coolant pipes and the tubes in the headers are very small, flow resistance of the coolant occurs and the coolant is hardly diffused.

In addition, flow resistance of the coolant occurs in the tubes and heat-exchange efficiency of the coolant is deteriorated due to oil contained in the coolant when the coolant passes through a heat-exchanging portion. Therefore, condensing efficiency of the coolant may be deteriorated.

Since the coolant pipes for discharging the liquefied coolant are mounted at a lower portion of the condenser that is a subcool region, flow rate of the coolant in which gas and liquid are separated is reduced. Therefore, cooling performance of the air conditioning may be deteriorated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a condenser for a vehicle having advantages of improving diffusing efficiency and heat-exchange efficiency of coolant by controlling flow of the coolant in which gaseous state and liquefied state are mixed and smoothly supplying the coolant from which oil is removed to a heat-exchanging portion and of improving cooling efficiency of an air conditioning by improving discharging efficiency of the coolant at a subcool region.

Various aspects of the present invention are directed to providing a condenser for a vehicle having advantages of simplifying a layout in a small engine compartment by enabling of connecting coolant pipes and tubes regardless of connecting direction.

A condenser for a vehicle according to an exemplary embodiment of the present invention may include first and second headers disposed apart from each other, a heat-exchanging portion provided with a plurality of tubes and radiation fins so as to lead heat-exchange between coolant passing through each tube and air, and connecting the first and second headers facing each other, a coolant tank mounted at an outer side of the first header and having a coolant inlet for receiving the coolant and a coolant outlet for discharging the coolant formed at a side thereof, the coolant tank being adapted to supply the coolant to the heat-exchanging portion through the first header and to receive through the first header the coolant passing through the heat-exchanging portion and the second header, and a receiver-drier portion connected to an outer side of the second header so as to perform gas-liquid separation and moisture removal from the coolant having passed through the heat-exchanging portion, wherein an inner space of the coolant tank is divided into an upper portion and a lower portion by a first partition disposed between the coolant inlet and the coolant outlet, and a spiral groove for causing the coolant to rotate and generating a whirlpool is formed at the upper portion connected to the coolant inlet.

The spiral groove may be integrally formed at an interior circumference of the upper portion of the coolant tank with respect to the first partition along a length direction of the coolant tank.

The first partition may be provided with an oil exhaust hole adapted to flow oil separated from the coolant during passing through the spiral groove to the lower portion of the coolant tank.

A wall may be formed in the coolant tank along a length direction thereof, at least one inflow holes for flowing the coolant into the heat-exchanging portion through the first header may be formed at an upper portion of the wall with respect to the first partition, and at least one exhaust holes for receiving the coolant from the first header may be formed at a lower portion of the wall.

The inflow holes may be evenly disposed at the wall along the length direction, and cross-sectional areas of the inflow holes may become smaller from the upper to the lower.

The exhaust holes may be evenly disposed at the wall along the length direction.

The first header, the coolant tank, and the wall may be integrally formed.

The first header, coolant tank, and the wall may be formed with two pieces and assembled with each other.

The first header may have a pipe shape to which the wall is integrally formed, and the coolant tank may enclose and be mounted to at least some portion of an exterior circumference of the first header.

The coolant tank may be formed with two pieces assembled with each other across the first header.

The first header may have a rounded plate shape having a surface at which the heat-exchanging portion is mounted.

The coolant tank and the wall may be integrally formed such that the coolant tank and the wall enclose and are mounted to an outer side of the first header at an opposite side of the heat-exchanging portion.

The coolant tank and the wall may be formed with two pieces assembled with each other across the first header.

The wall may enclose and be mounted to an outer side of the first header at an opposite side of the heat-exchanging portion, and the coolant tank may enclose and be mounted to an exterior circumference of the wall at an opposite side of the first header.

The coolant tank may be formed with two pieces assembled with each other across the wall.

A joint flange may be mounted at a side of the coolant tank where the coolant inlet and the coolant outlet are formed, and coolant pipes for receiving and discharging the coolant may be connected to the joint flange.

Sealing caps for preventing leakage of the coolant may be mounted respectively at upper and lower ends of the first header and the coolant tank.

Second and third partitions may be formed respectively at the first header and the second header so as to form a subcool region at a lower portion of the heat-exchanging portion.

The condenser may be provided with a heat exchanger of fin-plate type.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
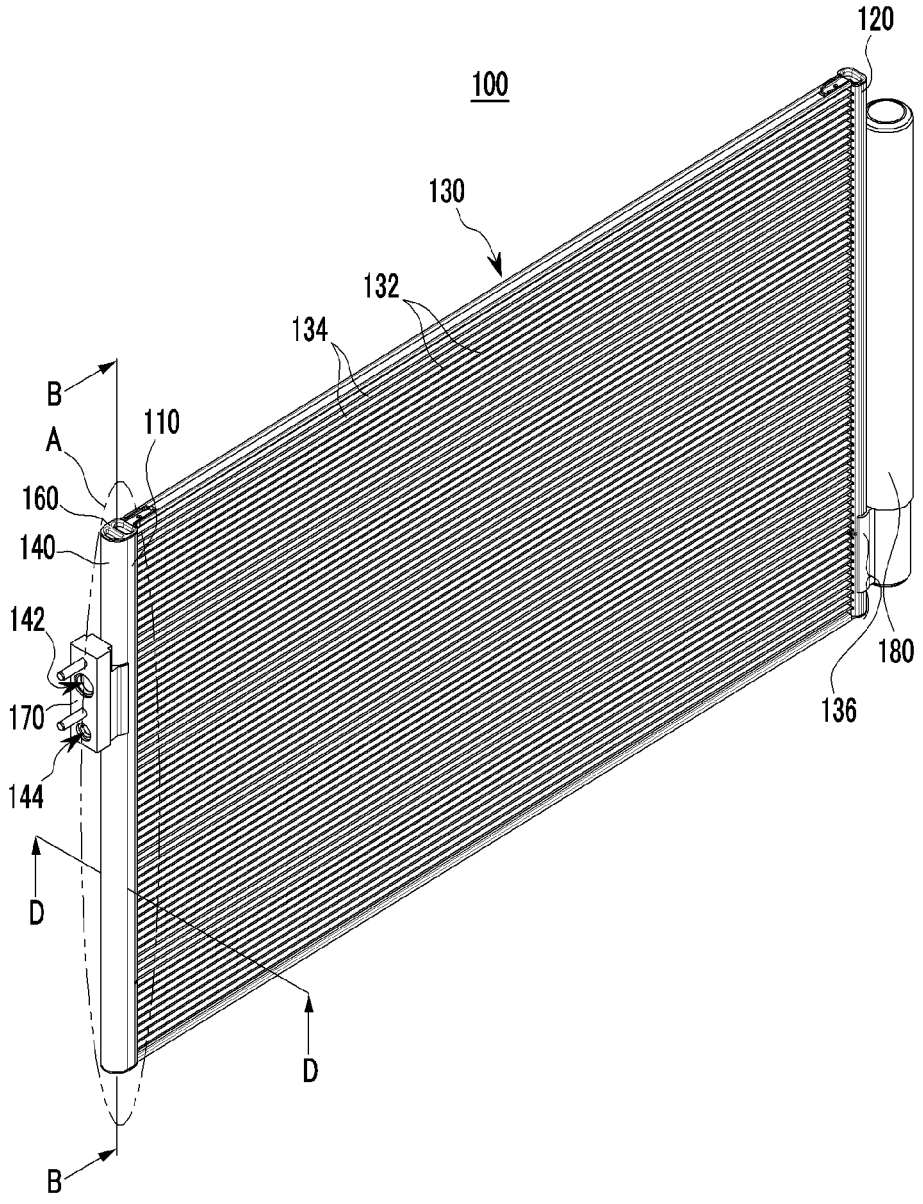
FIG. 1 is a perspective view of a condenser for a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Exemplary embodiments and drawings disclosed in this specification represent only a few exemplary embodiments of the present invention and do not represent all the spirit of the present invention. So, it is to be understood that various equivalents and variation can exist at the filing date of the present application.

Figure 2:
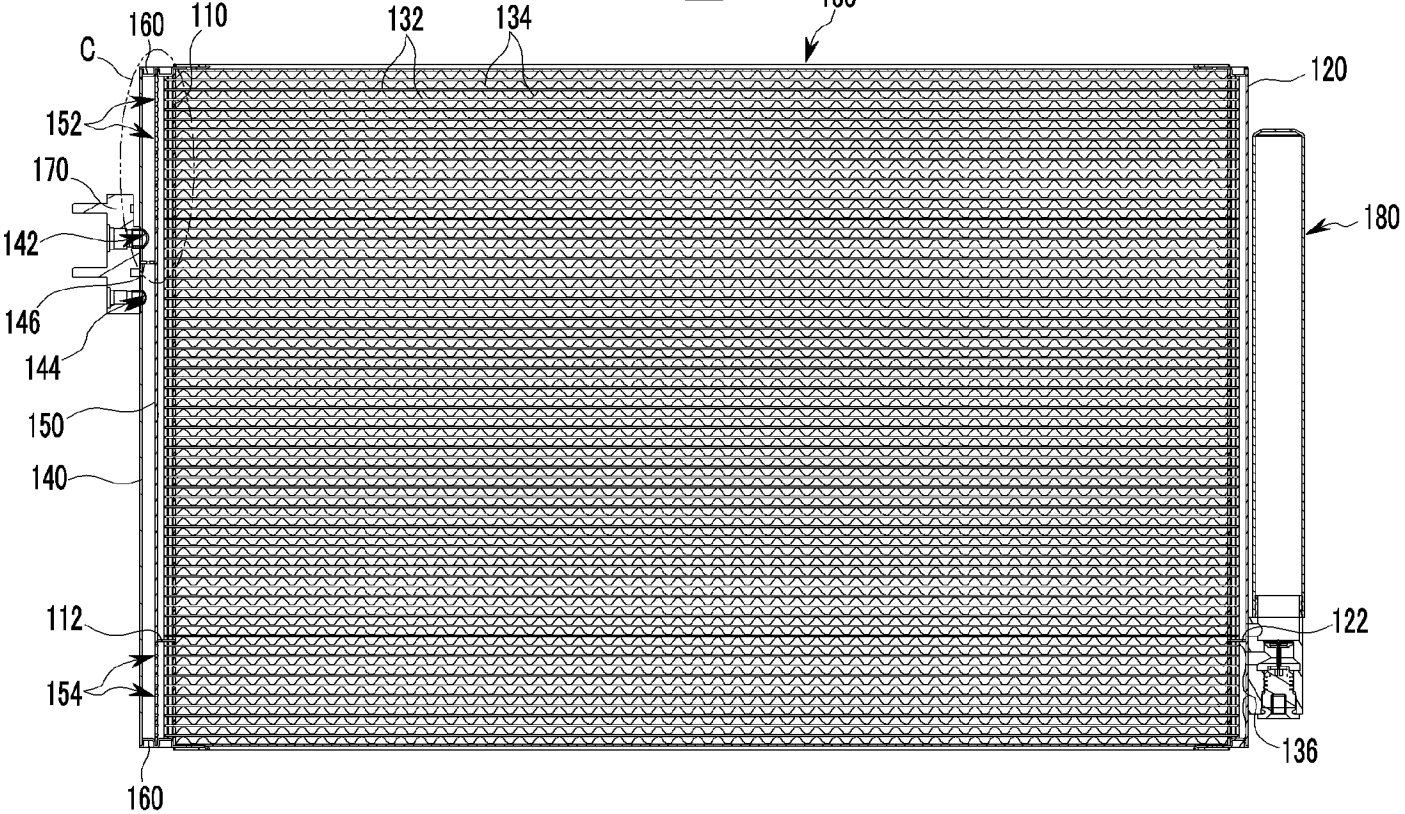
FIG. 2 is a cross-sectional view of a condenser for a vehicle according to an exemplary embodiment of the present invention.
Figure 3:
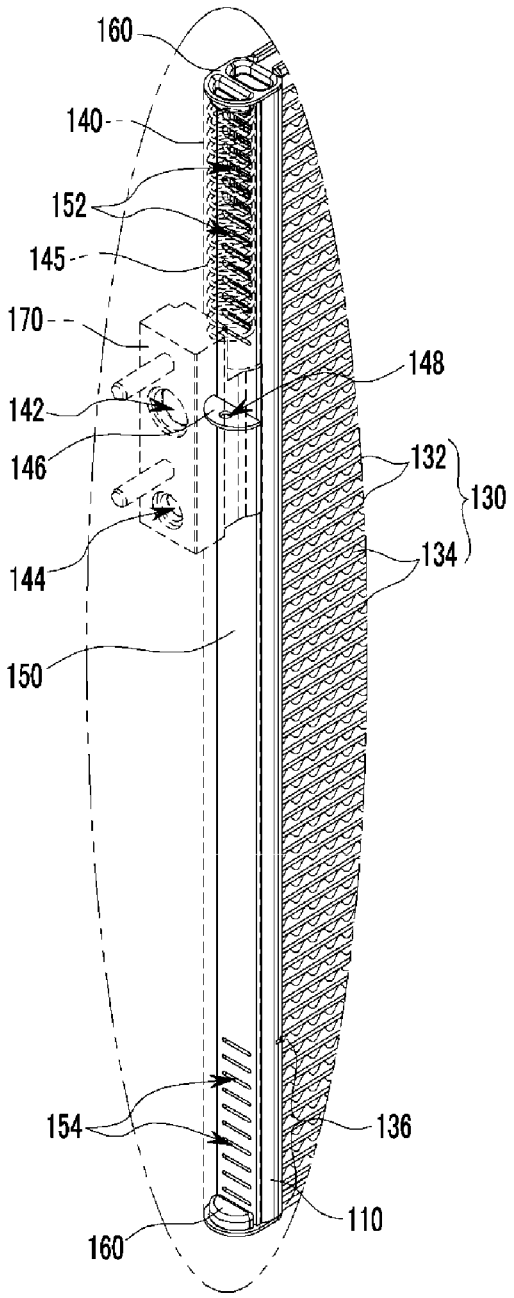
FIG. 3 is a projected perspective view of 'A' in FIG. 1.
Figure 4:
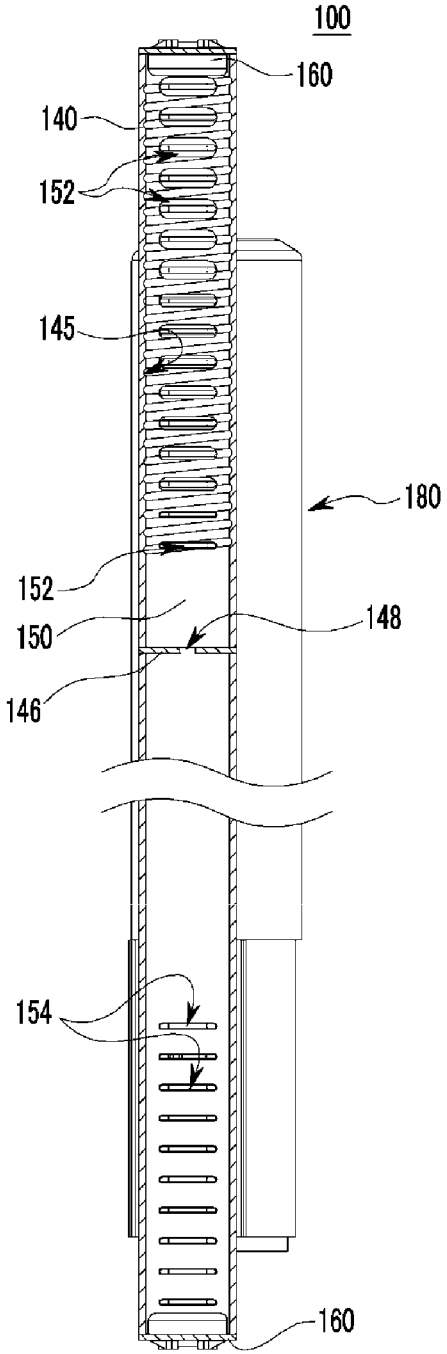
FIG. 4 is a cross-sectional view taken along the line B-B in FIG. 1.
Figure 5:
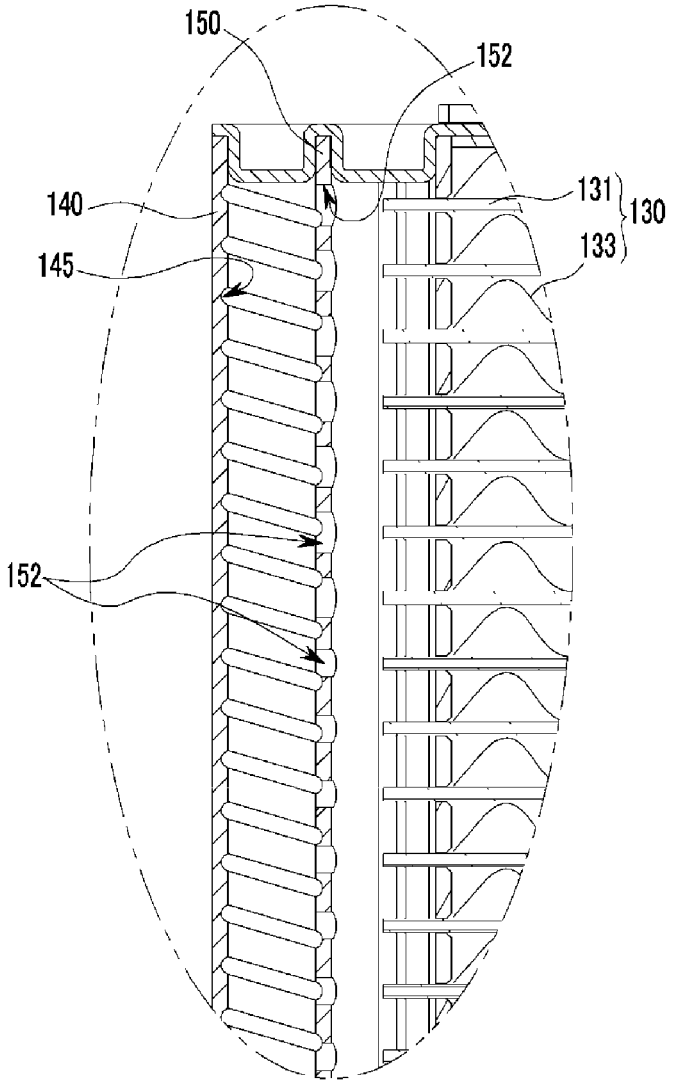
FIG. 5 is an enlarged view of 'C' part in FIG. 2.
Figure 6:
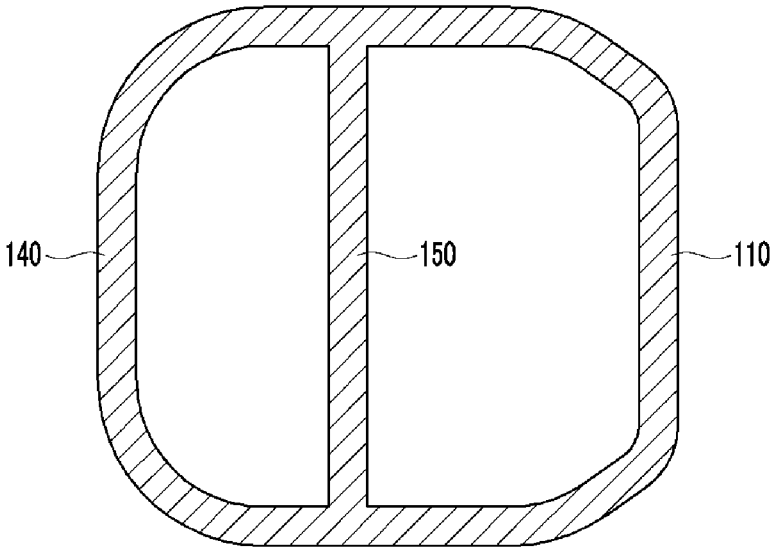
FIG. 6 is a cross-sectional view taken along the line D-D in FIG. 1.

FIG. 1 and FIG. 2 are a perspective view and a cross-sectional view of a condenser for a vehicle according to an exemplary embodiment of the present invention, FIG. 3 is a projected perspective view of 'A' in FIG. 1, FIG. 4 is a cross-sectional view taken along the line B-B in FIG. 1, FIG. 5 is an enlarged view of 'C' part in FIG. 2, and FIG. 6 is a cross-sectional view taken along the line D-D in FIG. 1.

Referring to the drawings, a condenser 100 for a vehicle according to an exemplary embodiment of the present invention is applied to an air conditioning of the vehicle. The condenser 100 can improve diffusing efficiency and heat-exchange efficiency of coolant by controlling flow of the coolant in which gaseous state and liquefied state are mixed and smoothly supplying the coolant from which oil is removed to a heat-exchanging portion 130. In addition, the condenser 100 can improve cooling efficiency of an air conditioning by improving discharging efficiency of the coolant at a subcool region 136.

For these purposes, the condenser 100 for the vehicle according to an exemplary embodiment of the present invention, as shown in FIG. 1 and FIG. 2, includes first and second headers 110 and 120, the heat-exchanging portion 130, a coolant tank 140, and a receiver-drier portion 180.

The first and second headers 110 and 120 are disposed apart from each other.

In the present exemplary embodiment, the heat-exchanging portion 130 includes a plurality of tubes 132 and radiation fins 134, and the coolant passing through each tube exchanges heat with air. The plurality of tubes 132 and radiation fins 134 is mounted at the first and second headers 110 and 120 so as to connect the first and second headers 110 and 120.

That is, the first and second headers 110 and 120 are disposed apart between the left and the right, as shown in FIG. 1. Both ends of the heat-exchanging portion 130 including the tubes 132 and the radiation fins 134 are connected respectively to inner sides of the first and second headers 110 and 120.

In addition, the coolant tank 140 is mounted at an outer of the first header 110 corresponding to the heat-exchanging portion 130.

A coolant inlet 142 for receiving the coolant and a coolant outlet 144 for discharging the coolant are formed at the coolant tank 140. The coolant supplied to the coolant tank 140 is supplied to the heat-exchanging portion 130 through the first header 110, and the coolant passing through the heat-exchanging portion 130 and the second header 120 is supplied back to the coolant tank 140 through the first header 110.

Herein, a first partition 146, as shown in FIG. 3 to FIG. 5 is formed at the coolant tank 140. The first partition 146 is disposed between the coolant inlet 142 and the coolant outlet 144 and divides an inner space formed between the first header 110 and the coolant tank 140 into an upper portion and a lower portion.

That is, the first partition 146 divides the coolant tank 140 into the upper portion and the lower portion with respect to the coolant inlet 142 and the coolant outlet 144.

In addition, a spiral groove 145 is formed at the upper portion of the coolant tank 140 divided by the first partition 146 and connected to the coolant inlet 142.

When the coolant supplied through the coolant inlet 142 flows, the spiral groove 145 causes the coolant to rotate and generates whirlpool so as to remove oil contained in the coolant.

Herein, the spiral groove 145 is integrally formed at an interior circumference of the upper portion of the coolant tank 140 with respect to the first partition 146 along a length direction of the coolant tank 140.

The spiral groove 145 causes the coolant to rotate when the coolant flowing in through the coolant inlet 142 flows upwardly in the coolant tank 140 separated by the first partition 146.

In this case, the coolant rotates along an interior circumference of the spiral groove 145 and the whirlpool is generated at a center portion of the coolant. At this time, the oil contained in the coolant is gathered in a center portion of the whirlpool by gravity and is dropped toward the first partition 146. Therefore, the oil is removed.

Herein, an oil exhaust hole 148 is formed at the first partition 146. The oil removed from the coolant when the coolant passes the spiral groove 145 is adapted to be exhausted together with the coolant exhausted through the coolant outlet 144.

The oil exhaust hole 148 is adapted to exhaust the oil removed from the coolant rotating and flowing along the spiral groove 145 and gathered on the first partition 146 into the coolant condensed when passing through the heat-exchanging portion 130.

Therefore, the oil exhausted through the oil exhaust hole 148 is mixed with the condensed coolant, and the coolant containing the oil is exhausted to an expansion valve through the coolant exhaust hole 144.

In the present exemplary embodiment, a wall 150 is formed in the coolant tank 140 along the length direction and an inner space in which the coolant is primarily stored is formed between the wall 150 and the first header 110.

In addition, at least one inflow hole 152 for supplying the coolant to the heat-exchanging portion 130 through the first header 110 is formed at an upper portion of the wall 150 with respect to the first partition 146, and at least one exhaust hole 154 for receiving the coolant through the first header 110 is formed at a lower portion of the wall 150.

Herein, the inflow holes 152 are evenly disposed at the wall 150 along the length direction, and cross-sectional areas of the inflow holes 152 become smaller from the upper to the lower.

Therefore, the coolant flowing into the coolant inflow hole 142 flows upwardly along the spiral groove 145 and eliminates the oil contained therein. In addition, when the coolant moves upwardly along the wall 150 with respect to the partition 146, increase of flow resistance can be prevented.

Therefore, when the coolant flows into the first header 110 through each inflow hole 152, the coolant can flows into the first header 110 uniformly in a state of minimizing flow resistance.

That is, the coolant flows into the first header 110 uniformly through the inflow holes 152 having different cross-sectional areas in a state of minimizing flow resistance, and then flows into each tube 132 of the heat-exchanging portion 130 uniformly.

In addition, the exhaust holes 154 are evenly disposed at the wall 150 along the length direction. The coolant exhausted through the exhaust holes 154 is stored in the coolant tank 140 and is exhausted to the exterior of the condenser 100 through the coolant exhaust hole 144.

Sealing caps 160 for preventing leakage of the coolant flowing into the first header 110 and the coolant tank 140 are mounted respectively at upper and lower ends of the first header 110 and the coolant tank 140.

The sealing caps 160 are mounted at the upper and lower ends of the first header 110 and the coolant tank 140 so as to prevent leakage of the coolant and prevent the coolant from flowing between the first header 110 and the coolant tank 140 without passing through the inflow hole 152 and the exhaust hole 154.

In addition, second and third partitions 112 and 122 for dividing the heat-exchanging portion 130 into an upper portion and a lower portion are formed such that inner spaces of the first and second headers 110 and 120 are divided. Thereby, the subcool region 135 for secondarily exchanging heat between the air and the coolant primarily condensed and having passed through the receiver-drier portion 180 is formed respectively at the first and second headers 110 and 120.

Herein, the subcool region 136 is formed at the lower portion of the heat-exchanging portion 130 by dividing the heat-exchanging portion 130 into the upper and lower portions by the second and third partitions 112 and 122. The coolant flows from the first header 110 to the second header 120 at the upper portion of the heat-exchanging portion 130 and flows from the second header 120 to the first header 110 at the subcool region 136.

In the present exemplary embodiment, a joint flange 170 is mounted at a side of the coolant tank 140 where the coolant inlet 142 and the coolant outlet 144 are formed. The joint flange 170 is connected to coolant pipes for receiving and discharging the coolant.

The joint flange 170 can enhance degree of freedom in layout of the coolant pipes by enabling of connecting the coolant pipes to the coolant inlet 142 and coolant outlet 144 at any position of an external circumference of the coolant tank 140.

In the present exemplary embodiment, the receiver-drier portion 180 is adapted to perform gas-liquid separation and moisture removal from the coolant having passed through the heat-exchanging portion 130 and is connected to the outer side of the second header 120.

The receiver-drier portion 180 receives the coolant having passed through the heat-exchanging portion 130 and having been condensed through the second header 120 and performs gas-liquid separation and moisture removal. In addition, the receiver-drier portion 180 flows the coolant to the subcool region 136 formed at the lower portion of the heat-exchanging portion 130 through the second header 120.

In the present exemplary embodiment, the first header 110, the coolant tank 140, and the wall 150, as shown in FIG. 6, are integrally formed.

That is, the first header 110, the coolant tank 140, and the wall 150 are integrally formed through extrusion.

In the present exemplary embodiment, the heat-exchanging portion 130 of the condenser 100 may be a heat exchanger of fin-plate including the tubes 132 and the radiation fins 134.

Operation of the condenser 100 for the vehicle according to an exemplary embodiment of the present invention will be described in detail.

Figure 7:
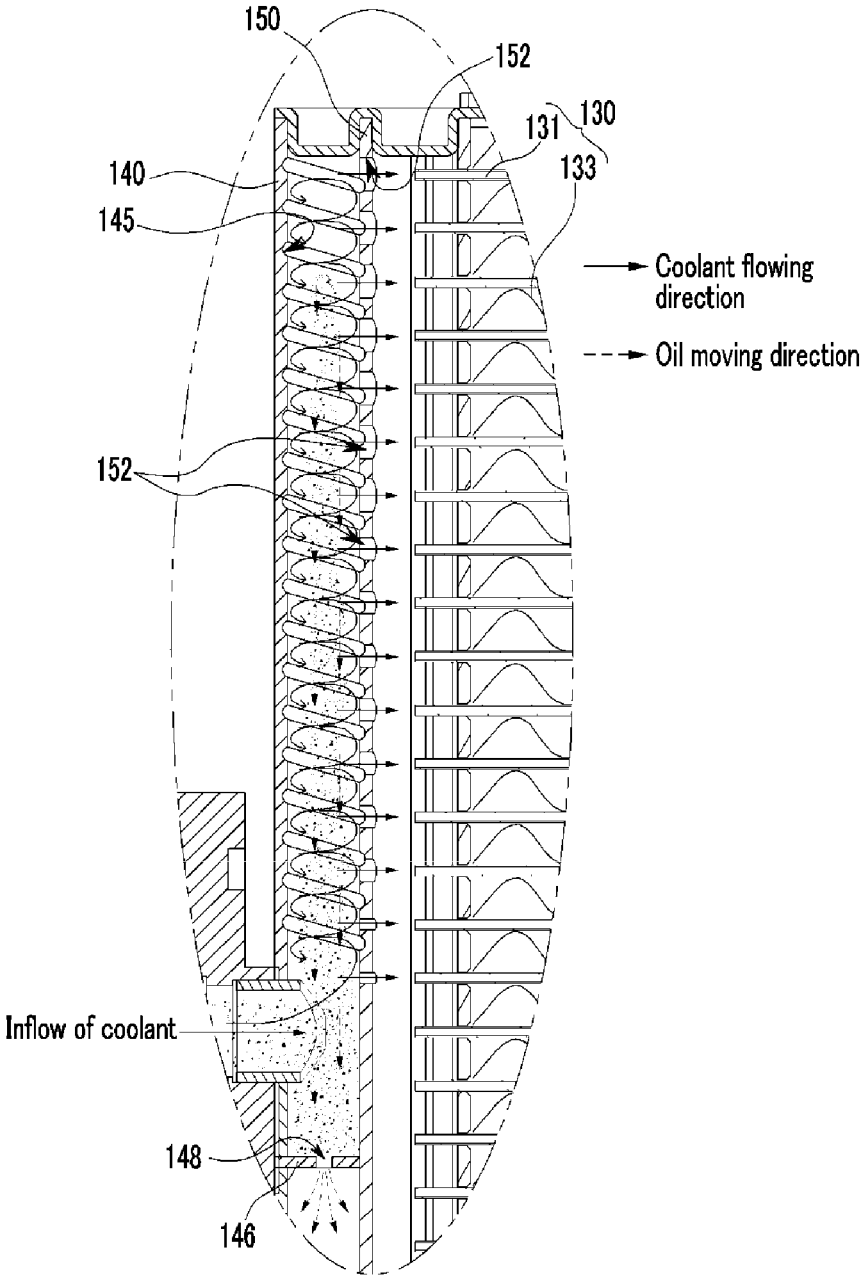
FIG. 7 is a partial cross-sectional view for showing operation of a condenser for a vehicle according to an exemplary embodiment of the present invention.

FIG. 7 is a partial cross-sectional view for showing operation of a condenser for a vehicle according to an exemplary embodiment of the present invention.

Referring to the drawing, after the coolant flowing in the coolant inlet 142 through the coolant pipe flows into the coolant tank 140, the coolant is rotated by the spiral groove 145 when flowing from the lower portion to the upper portion with respect to the first partition 146 in the condenser 100 for the vehicle according to the present exemplary embodiment.

At this time, the coolant is rotated along the interior circumference of the spiral groove 145 and forms the whirlpool at the center portion thereof. After the oil contained in the coolant is moved toward the whirlpool, the oil is dropped to the first partition 146 and is gathered.

Therefore, the coolant from which the oil contained therein is removed flows into the heat-exchanging portion 130 through the inflow holes 152 formed at the wall 150.

When the coolant flows into the inflow holes 152, a small amount of the coolant flows into the inflow hole 152 having a smaller cross-sectional area at the lower portion positioned close to the coolant inlet 142 and where pressure of the coolant is high.

Since the upper portion of coolant tank 140, on the contrary, is far away from the coolant inlet 142 with respect to the first partition 146, pressure of the coolant at the upper portion is lower than that at the lower portion. Therefore, a large amount of the coolant can flow into the inflow hole 152 having larger cross-sectional area even though the pressure of the coolant is low.

Therefore, the coolant can be uniformly supplied to the heat-exchanging portion 130 from the lower portion to the upper portion of the first header 110.

That is, the condenser 100 according to an exemplary embodiment of the present invention can improve heat-exchange efficiency of the coolant by smoothly flowing the coolant from which the oil is removed into the tubes 132 positioned between the upper portion and the lower portion of the heat-exchanging portion 130.

In addition, the coolant flowing into the heat-exchanging portion 130 is adapted to primarily exchange heat with the air and be condensed when passing through the heat-exchanging portion 130, and gas-liquid separation and moisture removal is performed when the coolant passes through the receiver-drier portion 180.

At this state, the coolant flows into the heat-exchanging portion 130 again through the second header 120, exchanges heat with the air at the subcool region 136, and flows into the first header 110 again.

The coolant flowing into the first header 110 is uniformly discharged to the lower portion of the coolant tank 140 with respect to the first partition 146 through the exhaust holes 154.

In addition, the condensed coolant flowing into the coolant tank 140 is exhausted to the coolant pipe through the coolant outlet 144. At this time, since the coolant outlet 144 is far away from the exhaust holes 154 for exhausting the coolant and is positioned close to the coolant inlet 142, flow resistance near the coolant outlet 144 is lowered.

Therefore, after the coolant exhausted from the subcool region 136 of the heat-exchanging portion 130 is stored in the coolant tank 140, the coolant is exhausted to the coolant pipe through the coolant outlet 144. Therefore, the flow resistance of the coolant may become lower and the coolant may be exhausted smoothly.

If the condenser 100 for the vehicle according to an exemplary embodiment of the present invention is used, flow of the coolant in which gaseous state and liquid state are mixed is controlled and the coolant from which the oil is removed is supplied smoothly to the heat-exchanging portion 130.

Therefore, the condenser 100 for the vehicle according to an exemplary embodiment of the present invention may improve diffusing efficiency and heat-exchange efficiency of the coolant and cooling efficiency of the air conditioning by improving discharging efficiency of the coolant at the subcool region 135.

In addition, the whirlpool is generated due to rotation of the coolant when the coolant flows through the spiral groove 145 formed at the coolant tank 140. Therefore, the oil contained in the coolant can be removed from the coolant by gravity without an additional oil separation device, and the removed oil may be exhausted together with the condensed coolant.

Since the coolant pipe can be connected to the tube 132 regardless of connecting direction, a layout in a small engine compartment may be simplified.

Since the coolant pipes for receiving and exhausting the coolant are mounted through the joint flange 170, manufacturing cost and processes and size of the condenser may be reduced.

Meanwhile, when explain the condenser 100 for the vehicle according to an exemplary embodiment of the present invention, it is exemplified, but not limited to, that the first header 110, the fuel tank 140 and the wall 150 are integrally formed. Various shapes of the first header 110, the fuel tank 140, and the wall 150 can be manufactured separately.

Figure 8:
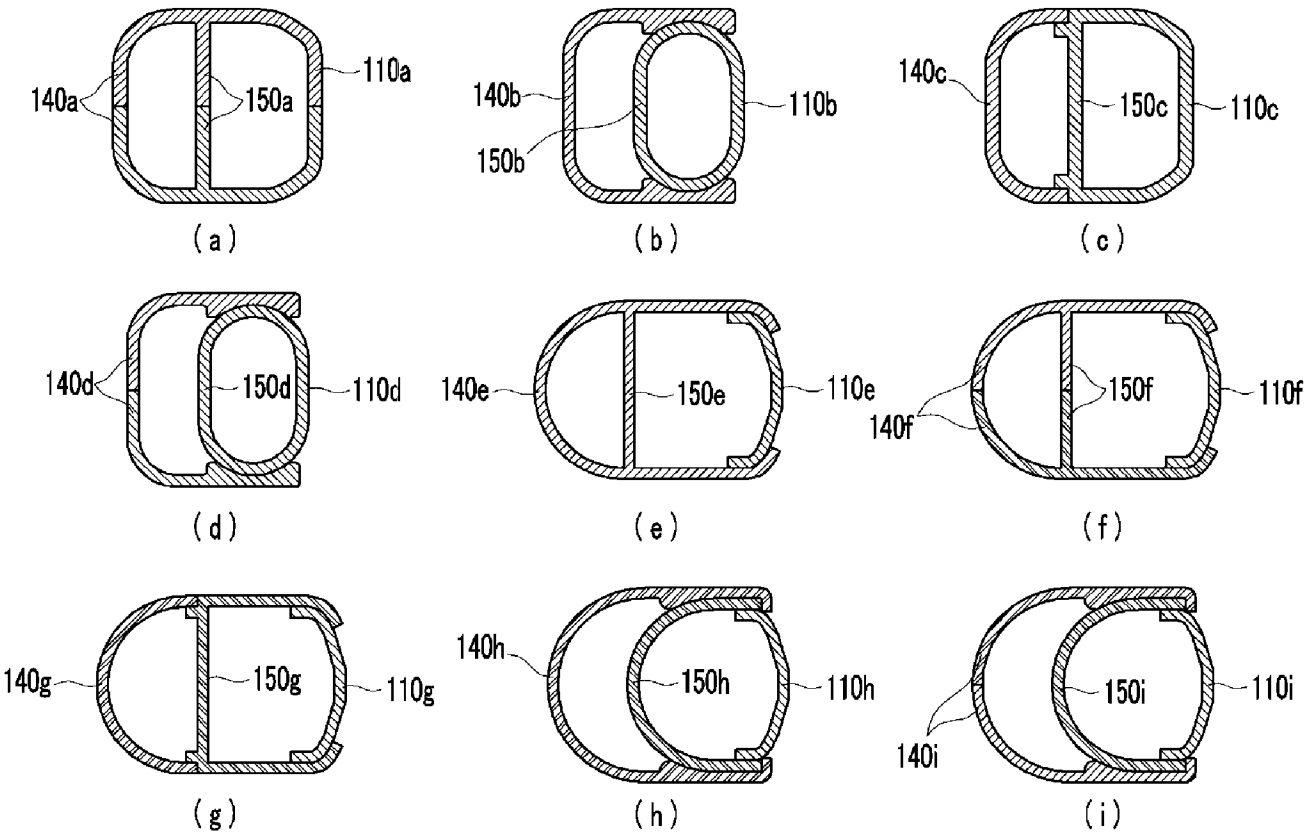
FIG. 8 is a cross-sectional view for showing various coupling structures of the first header, the wall, and the coolant tank used in a condenser for a vehicle according to an exemplary embodiment of the present invention.

FIG. 8 is a cross-sectional view for showing various coupling structures of the first header, the wall, and the coolant tank used in a condenser for a vehicle according to an exemplary embodiment of the present invention.

As shown in (a) of FIG. 8, the first header 110*a*, coolant tank 140*a*, and the wall 150*a* are formed with two pieces and the two pieces are assembled.

That is, the first header 110*a* and the coolant tank 140*a* include first portion and a second portion separately manufactured, and the walls 150*a* are integrally protruded from middle portions of the first portion and the second portion. The first portion and the second portion are assembled through welding.

After the first portion and the second portion of the first header 110*a*, the coolant tank 140*a*, and the wall 150*a* are separately manufactured through extrusion, the first portion and the second portion are assembled with each other.

As shown in (b) to (d) of FIG. 8, the first header 110*b*, 110*c*, and 110*d* has a pipe shape with which the wall 150*b*, 150*c*, and 150*d* is integrally formed, and the coolant tank 140*b*, 140*c*, and 140*d* encloses and is mounted to at least some portion of an exterior circumference of the first header 110*b*, 110*c*, and 110*d*.

Meanwhile, the coolant tank 140*d*, as shown in (d) of FIG. 8, is formed with two pieces assembled with each other across the first header 110*d*.

In addition, the first header 110*e*, 110*f*, 110*g*, 110*h*, and 110*i*, as shown in (e) to (i) of FIG. 8, has a rounded plate shape having a surface at which the heat-exchanging portion 130 is mounted.

Herein, the coolant tank 140*e* and the wall 150*e*, as shown in (e) of FIG. 8, are integrally formed such that the coolant tank 140*e* and the wall 150*e* enclose and are mounted to the outer side of the first header 110*e* at an opposite side of the heat-exchanging portion 130.

In addition, the coolant tank 140*f* and the wall 150*f*, as shown in (f) of FIG. 8, are formed with two pieces assembled with each other across the first header 110*f*.

That is, the coolant tank 140*f* includes a first portion and a second portion, and the walls 150*f* are integrally protruded from middle portions of the first portion and the second portion. The first portion and the second portion are assembled through welding.

Meanwhile, the wall 150*g*, 150*h*, and 150*i*, as shown in (g) to (i) of FIG. 8, encloses and is mounted to the outer side of the first header 110*g*, 110*h*, and 110*i* at an opposite side of the heat-exchanging portion 130.

The wall 150*g*, 150*h*, and 150*i* has a semicircular shape or "C" shape so as to enclose and be mounted to the outer side of the first header 110*g*, 110*h*, and 110*i* having the rounded plate shape.

Herein, the coolant tank 140*g* and 140*h*, as shown in (g) to (h) of FIG. 8, has a semicircular shape so as to enclose and be mounted to an exterior circumference of the wall 150*g* and 150*h*.

In addition, the coolant tank 140*i*, as shown in (i) of FIG. 8, is formed with two pieces assembled to each other across the wall 150*i*.

That is, the coolant tank 140*i* includes a first portion and a second portion, and encloses and is mounted through welding to the exterior circumference of the wall 150*i* enclosing and mounted to the exterior circumference of the first header 110*i*.

As described above, the first header 110, the coolant tank 140, and the wall 150 are integrally formed or separately formed with various shapes and then assembled according to an exemplary embodiment of the present invention.

According to an exemplary embodiment of the present invention, flow of the coolant in which gaseous state and liquid state are mixed is controlled and the coolant from which the oil is removed is supplied smoothly to the heat-exchanging portion. Therefore, diffusing efficiency and heat-exchange efficiency of the coolant and cooling efficiency of the air conditioning may be improved by improving discharging efficiency of the coolant at the subcool region.

In addition the oil contained in the coolant can be easily removed from the coolant by gravity without the additional oil separation device by controlling flow of the coolant through the spiral groove formed in the coolant tank. In addition, the removed oil may be exhausted together with the condensed coolant.

Since the coolant pipe can be connected to the tubes regardless of connecting direction, a layout in a small engine compartment may be simplified.

Since the coolant pipes for receiving and exhausting the coolant are mounted through the joint flange, manufacturing cost and processes and size of the condenser may be reduced.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A condenser for a vehicle, comprising:

first and second headers disposed apart from each other;

a heat-exchanging portion disposed between the first and second headers and provided with a plurality of tubes and radiation fins so as to lead heat-exchange between coolant passing through each tube and air;

a coolant tank mounted at an outer side of the first header and having a coolant inlet for receiving the coolant and a coolant outlet for discharging the coolant formed at a side thereof, the coolant tank being adapted to supply the coolant to the heat-exchanging portion through the first header and to receive through the first header the coolant passing through the heat-exchanging portion and the second header; and a receiver-drier portion connected to an outer side of the second header so as to perform gas-liquid separation and moisture removal from the coolant having passed through the heat-exchanging portion, wherein an inner space of the coolant tank is divided into an upper portion and a lower portion by a first partition disposed between the coolant inlet and the coolant outlet, and a spiral groove for causing the coolant to rotate and generating a whirlpool is formed at the upper portion connected to the coolant inlet.

2. The condenser of claim 1, wherein the spiral groove is integrally formed at an interior circumference of the upper portion of the coolant tank with respect to the first partition along a length direction of the coolant tank.

3. The condenser of claim 1, wherein the first partition is provided with an oil exhaust hole fluid-connecting the upper portion and the lower portion of the coolant tank to flow oil separated from the coolant during passing through the spiral groove to the lower portion of the coolant tank.

4. The condenser of claim 3, wherein the coolant outlet is disposed closer to the coolant inlet than the at least one exhaust holes.

5. The condenser of claim 1, wherein a wall is formed between the coolant tank and the first header in the coolant tank along a length direction of the coolant tank, wherein at least one inflow holes for flowing the coolant into the heat-exchanging portion through the first header is formed at an upper portion of the wall with respect to the first partition, and wherein at least one exhaust holes for receiving the coolant from the first header is formed at a lower portion of the wall.

6. The condenser of claim 5, wherein the inflow holes are evenly disposed at the wall along the length direction thereof, and cross-sectional areas of the inflow holes become smaller from the upper to the lower of the upper portion in the coolant tank.

7. The condenser of claim 5, wherein the exhaust holes are evenly disposed at the wall in the lower portion of the wall along the length direction thereof.

8. The condenser of claim 5, wherein the first header, the coolant tank, and the wall are integrally formed.

9. The condenser of claim 5, wherein the first header, the coolant tank, and the wall are formed with two pieces and assembled with each other.

10. The condenser of claim 5, wherein the first header has a pipe shape to which the wall is integrally formed, and the coolant tank encloses and is mounted to at least some portion of an exterior circumference of the first header.

11. The condenser of claim 10, wherein the coolant tank is formed with two pieces assembled with each other across the first header.

12. The condenser of claim 5, wherein the first header has a rounded plate shape having a surface at which the heat-exchanging portion is mounted.

13. The condenser of claim 12, wherein the coolant tank and the wall are integrally formed such that the coolant tank and the wall enclose and are mounted to an outer side of the first header at an opposite side of the heat-exchanging portion.

14. The condenser of claim 12, wherein the coolant tank and the wall are formed with two pieces assembled with each other across the first header.

15. The condenser of claim 12, wherein the wall encloses and is mounted to an outer side of the first header at an opposite side of the heat-exchanging portion, and the coolant tank encloses and is mounted to an exterior circumference of the wall at an opposite side of the first header.

16. The condenser of claim 15, wherein the coolant tank is formed with two pieces assembled with each other across the wall.

17. The condenser of claim 5, wherein second and third partitions are formed respectively at the first header and the second header and divides the heat-exchanging portion into an upper portion and a lower portion so as to form a subcool region at the lower portion of the heat-exchanging portion and receive coolant from the receiver-drier portion to transmit the coolant to the at least one exhaust holes.

18. The condenser of claim 1, wherein a joint flange is mounted at a side of the coolant tank where the coolant inlet and the coolant outlet are formed, and coolant pipes for receiving and discharging the coolant are connected to the joint flange.

19. The condenser of claim 1, wherein sealing caps for preventing leakage of the coolant are mounted respectively at upper and lower ends of the first header and the coolant tank.

20. The condenser of claim 1, wherein the condenser is provided with a heat exchanger of fin-plate type.

* * * * *